US007774895B2

(12) United States Patent
Hansen et al.

(10) Patent No.: US 7,774,895 B2
(45) Date of Patent: Aug. 17, 2010

(54) EXTRACTION WITH CHEMICAL EXOTHERMIC REACTION HEATING

(75) Inventors: Eric J. Hansen, Ada, MI (US); Thomas K. Ankney, East Grand Rapids, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 0 days.

(21) Appl. No.: 11/612,887

(22) Filed: Dec. 19, 2006

(65) Prior Publication Data

US 2007/0089261 A1 Apr. 26, 2007

Related U.S. Application Data

(62) Division of application No. 10/065,480, filed on Oct. 22, 2002, now Pat. No. 7,153,371.

(60) Provisional application No. 60/348,103, filed on Oct. 23, 2001.

(51) Int. Cl.
*A47L 7/00* (2006.01)

(52) U.S. Cl. ..... 15/320

(58) Field of Classification Search ..... 15/320–322; *A47L 7/00*

See application file for complete search history.

(56) References Cited

U.S. PATENT DOCUMENTS 3,357,923 A 12/1967 Wool et al.
3,772,203 A 11/1973 Frederick
3,874,365 A 4/1975 Pava
3,942,510 A 3/1976 Garrett
4,425,251 A 1/1984 Gancy
4,522,190 A 6/1985 Kuhn et al.
4,793,323 A 12/1988 Guida et al.
4,940,082 A * 7/1990 Roden ..... 15/321
5,163,504 A 11/1992 Resnick
5,275,156 A 1/1994 Milligan et al.
5,341,541 A 8/1994 Sham
5,390,659 A 2/1995 Scaringe et al.
5,653,106 A 8/1997 Katashiba et al.
5,979,164 A 11/1999 Scudder et al.
6,029,651 A 2/2000 Dorney
6,092,519 A 7/2000 Fish et al.

(Continued)

FOREIGN PATENT DOCUMENTS

AU 6362586 4/1987

(Continued)

*Primary Examiner*—David A Redding
(74) *Attorney, Agent, or Firm*—McGarry Bair PC

(57) ABSTRACT

An extraction cleaning machine comprising dispensing and recovery systems, the dispensing system including a system for generating heat with an exothermic reaction upon activation for heating the cleaning solution prior to dispensing of the cleaning solution onto a surface. The cleaning solution dispensing system comprises a cleaning solution reservoir to which the heat of the exothermic reaction can be added and a dispenser. The heat of the exothermic reaction can also be added in line to the cleaning solution between the cleaning solution reservoir and the dispenser. The recovery system includes a suction nozzle, a recovery tank and a vacuum source for drawing recovered liquid from the suction nozzle into the recovery tank. A method of cleaning a surface comprises the steps of heating a cleaning solution by an exothermic chemical reaction, applying the cleaning solution to the surface and recovering the cleaning solution from the surface.

34 Claims, 8 Drawing Sheets

U.S. PATENT DOCUMENTS

| | | | |
|---|---|---|---|
| 6,125,498 | A | 10/2000 | Roberts et al. |
| 6,131,237 | A | 10/2000 | Kasper et al. |
| 6,167,586 | B1 | 1/2001 | Reed, Jr. et al. |
| 2002/0040503 | A1 | 4/2002 | Pace et al. |
| 2002/0112741 | A1 | 8/2002 | Pieroni et al. |
| 2002/0129835 | A1 | 9/2002 | Pieroni et al. |

FOREIGN PATENT DOCUMENTS

| | | |
|---|---|---|
| JP | 63061097 | 3/1988 |

* cited by examiner

EXTRACTION WITH CHEMICAL EXOTHERMIC REACTION HEATING

CROSS-REFERENCE TO RELATED APPLICATION

This application is a divisional of U.S. application Ser. No. 10/065,480, filed Oct. 22, 2002, now U.S. Pat. No. 7,153,371, issued Dec. 26, 2006 and claims the benefit of U.S. Provisional Application No. 60/348,103, filed on Oct. 23, 2001.

BACKGROUND OF THE INVENTION

1. Field of the Invention

The invention relates to extraction cleaning. In one of its aspects, the invention relates to an extraction cleaner in which a cleaning solution is heated by an exothermic reaction. In another of its aspects, the invention relates to a method of cleaning a floor surface such as a carpet with a heated cleaning solution. In another of its aspects, the invention relates to heating a cleaning solution in an extraction cleaner by an exothermic reaction and applying the heated solution to a floor surface for cleaning.

2. Description of the Related Art

An extraction cleaning machine having a heater for dispensing a heated cleaning solution is disclosed in U.S. Pat. No. 6,131,237, incorporated herein by reference in its entirety.

U.S. Pat. No. 4,522,190 discloses a flexible electrochemical heater comprising a supercorroding metallic alloy powder dispersed throughout a porous polyethylene matrix. Upon the addition of a suitable electrolyte fluid, such as a sodium chloride solution, heat is rapidly and efficiently produced. The electrochemical heater element can be contained in a porous envelope through which fluid can pass for reacting with the alloy powder to generate heat while keeping the alloy powder contained within the envelope.

U.S. Pat. No. 5,163,504 discloses a package heating device in the form of a membrane holding a quantity of microscopic spheres containing a hydrous substance such as water or saline solution. The membrane further contains an anhydrous substance such as magnesium sulfate proximate to the spheres containing the water or saline solution. The anhydrous substance can also be contained in spheres. To activate the heating device, the spheres are mechanically broken to release the substances contained therein. The blending of the hydrous and anhydrous substances within the membrane generates an exothermic reaction releasing heat into the container associated with the heating device.

A container having an integral module for heating the contents is disclosed in U.S. Pat. No. 5,979,164. By way of example, the integral module functions as a cap for the container and comprises a sealed cavity holding the reactants for an exothermic reaction. The reactants are physically separated until a user wishes to initiate the exothermic reaction. In use, a liquid is placed in the container and the module is placed on the container in contact with the liquid. The reactants are then mixed within the sealed cavity to generate the exothermic reaction, the resultant heat being transferred from the module to the liquid in the container while the reactants remain fluidly isolated from the liquid.

U.S. Pat. No. 6,029,651 discloses a cup enclosing an aqueous sodium acetate solution and a metallic activator strip in a cavity formed between inner and outer walls of the cup. The aqueous sodium acetate solution is supercooled. The activator strip is a flexible metal strip accessible to a user through a flexible portion of the outer wall of the cup. When the user flexes the activator strip, it initiates a crystallization of the sodium acetate with an accompanying generation of heat, which can then be transferred to the contents of the cup. The sodium acetate is returned to the supercooled condition by heating above its melting point and air cooling. Flexing of the activator strip will again initiate crystallization. This cycle can be repeated indefinitely, making the cup reusable for heating fluids.

SUMMARY OF THE INVENTION

According to an embodiment of the invention, a kit for cleaning a surface to be cleaned comprises a cleaning solution and an extraction cleaner having a housing, a cleaning solution dispensing system, a fluid recovery system and an exothermic heating system adapted to be placed in heat exchange relationship with the cleaning solution dispensing system to heat the cleaning solution to a temperature above room temperature for application to the surface to be cleaned. The exothermic heating system can comprise at least one reagent that is adapted to generate an exothermic reaction. When the cleaning solution is added to the cleaning solution dispensing system, the exothermic heating system is placed in heat exchange relationship with the cleaning solution dispensing system and the exothermic heating system is activated to generate an exothermic reaction, the cleaning solution is heated, whereby the cleaning solution thus heated can be applied to a surface to be cleaned for enhanced cleaning.

According to another embodiment of the invention, the exothermic heating system can comprise at least one compound or composition that can generate heat when transforming from one phase to another. The phase change can include changing phase from a liquid to a solid or from one solid phase to another. The exothermic heating system can also comprise a sodium acetate solution and can further include an activator that can be introduced into the sodium acetate solution. The activator can be in the form of a metal.

In another embodiment, the exothermic heating system can comprise two or more reagents that, when combined, undergo an exothermic reaction. The two or more reagents can include a base and an acid that undergo an exothermic reaction when combined. The exothermic heating system can comprise a mild acid in the cleaning solution tank and the cleaning solution can have a pH less than 7. The acid can be selected from the group consisting of stearic acid, citric acid and phosphoric acid. The base can be selected from the group consisting of diethanolamine, triethanolamine, sodium hydroxide and potassium hydroxide. A reaction product of the mild acid and base can be a surfactant that becomes part of the cleaning solution.

According to another embodiment of the invention, the exothermic heating system can comprise two or more reagents that, when combined, undergo an exothermic reaction. The two or more reagents can include a base and an acid that undergo an exothermic reaction when combined. The exothermic heating system can comprise a mild acid in the cleaning solution tank and the cleaning solution can have a pH less than 7. The acid can be selected from the group consisting of stearic acid, citric acid and phosphoric acid. The base can be selected from the group consisting of diethanolamine, triethanolamine, sodium hydroxide and potassium hydroxide. A reaction product of the mild acid and base can be a surfactant that becomes part of the cleaning solution.

According to another embodiment of the invention, an extraction cleaner can comprise a housing, a cleaning solution dispensing system, a fluid recovery system and a heater in heat exchange relationship with the cleaning solution dispensing system to heat the cleaning solution. The heater can include a double wall receptacle having an outer wall and an inner wall, the inner wall defining the cleaning solution tank for storing the cleaning solution, the inner and outer wall defining a reagent cavity, and an exothermic heating system comprising at least one reagent and at least one activator. The at least one activator can be integral with the outer wall of the reagent cavity for generating heat through an exothermic reaction in the reagent cavity. When heat is generated in the reagent cavity by the exothermic heating system, the heat can be transferred from the reagent cavity to the cleaning solution in the cleaning solution tank through the inner wall of the heater.

According to yet another embodiment of the invention, an extraction cleaner can comprise a housing, a cleaning solution dispensing system, a fluid recovery system and a heater in heat exchange relationship with the cleaning solution dispensing system to heat the cleaning solution. The heater can include a double wall receptacle having an outer wall and an inner wall, the inner wall defining the cleaning solution tank for storing the cleaning solution, the inner and outer wall defining a reagent cavity, an exothermic heating system comprising at least one reagent for generating heat through an exothermic reaction in the reagent cavity and at least one anode and one cathode located within the reagent cavity. When heat is generated in the reagent cavity by the exothermic heating system, the heat can be transferred from the reagent cavity to the cleaning solution in the cleaning solution tank through the inner wall of the heater. The exothermic heating system can be regenerated by applying an electric potential across the at least one anode and the at least one cathode.

DESCRIPTION OF THE PREFERRED EMBODIMENT

Figure 1:
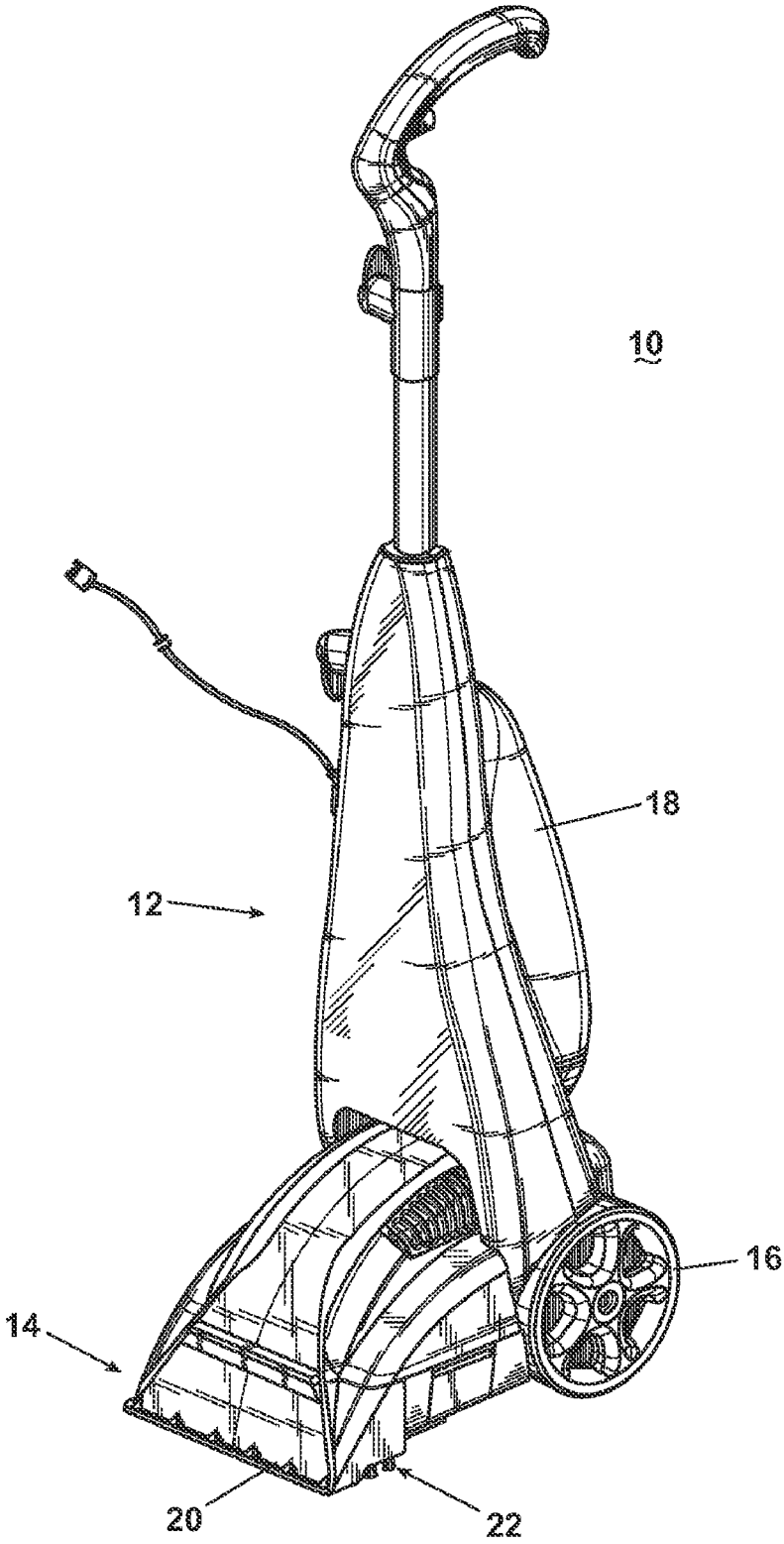
FIG. 1 is a perspective view of an extraction cleaner according to the invention.

Referring to FIG. 1, an upright extraction cleaner 10 according to the invention comprises an upright handle 12 and a base 14. A clean solution tank 18 is carried by the upright handle 12. The base 14 is partially supported by wheels 16 and by suction nozzle 20. A fluid dispensing nozzle 22 is disposed on an underside of the base 14 to the rear of the suction nozzle 20 for dispensing a cleaning solution on a surface being cleaned.

Extraction cleaning using exothermic chemical heat according to the invention is not limited to the upright extraction cleaner 10 of FIG. 1, but also includes application in a canister-type or portable hand-held extraction cleaner. The extraction cleaner according to the invention includes a fluid dispensing system for applying a cleaning solution to a surface being cleaned, and further includes a fluid recovery system for removing soiled solution from the surface being cleaned. These systems are described in further detail in U.S. Pat. Nos. 6,125,498, 6,131,237 and 6,167,586 and U.S. patent application Ser. No. 09/755,724, filed Jan. 5, 2001, all of which are commonly owned with this application and are incorporated herein by reference in their entirety.

Figure 2:
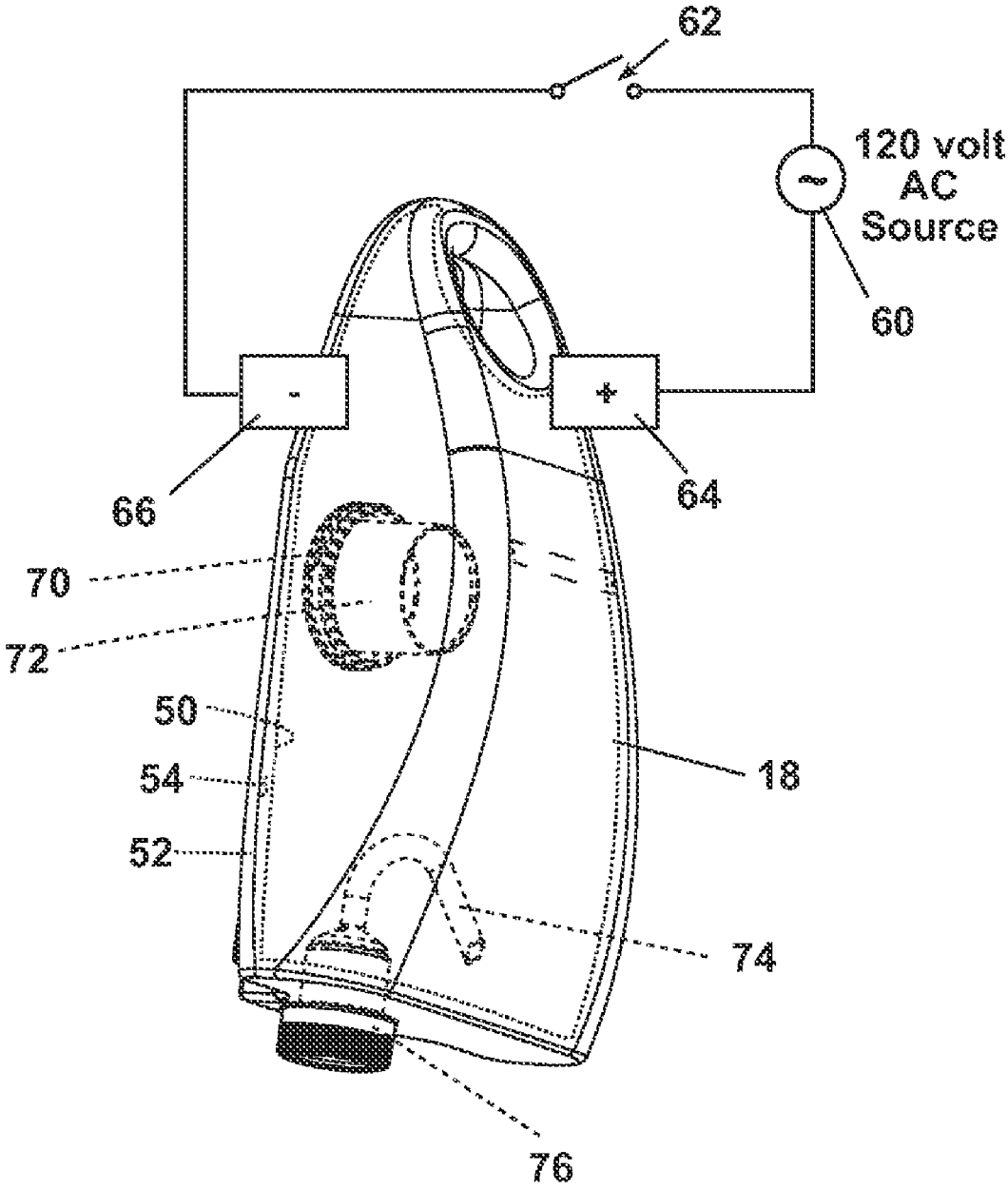
FIG. 2 is a perspective view of a clean solution tank of the extraction cleaner of FIG. 1 illustrating one embodiment of the invention.
Figure 3:
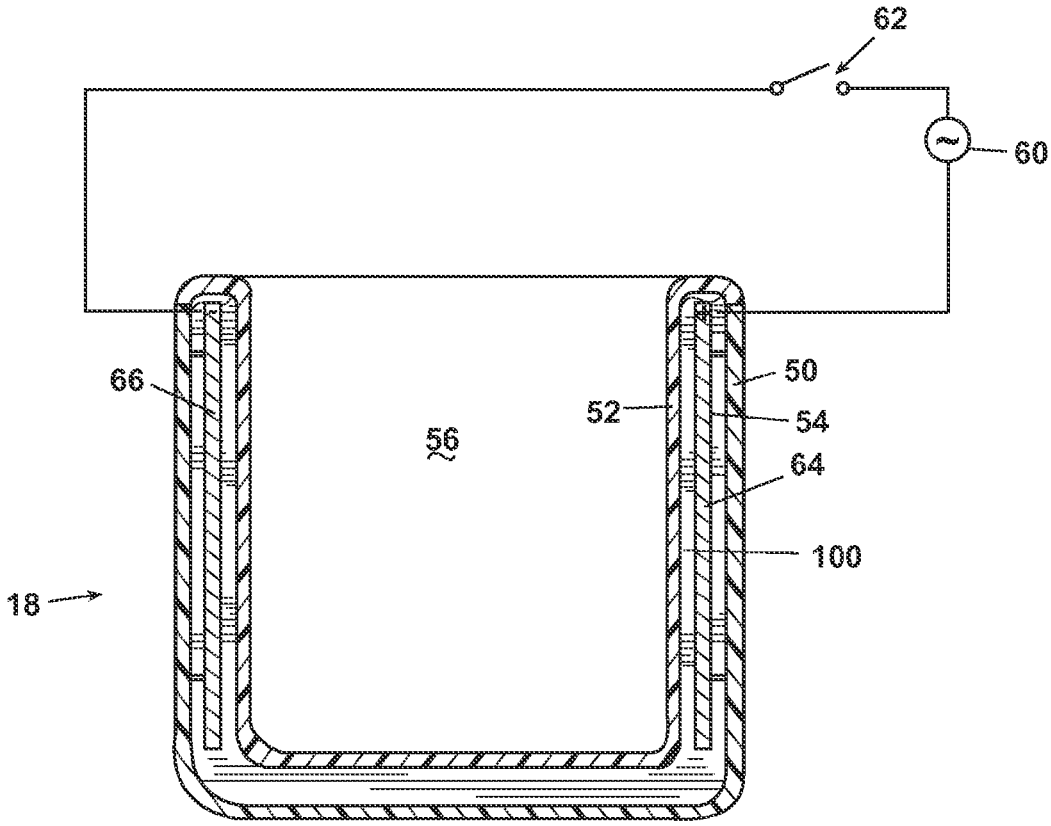
FIG. 3 is a schematic cross-sectional view of the clean solution tank illustrated in FIG. 2.

Referring now to FIGS. 2-3, clean solution tank 18 comprises a double-walled receptacle formed by an inner wall 52 and an outer wall 50 defining a cavity 54 therebetween. The inner wall 52 defines a chamber 56 for holding a cleaning solution. Chamber 56 is filled with cleaning solution through fill opening 70, which is selectively sealed with cap 72. The cavity 54 defined between the inner wall 52 and the outer wall 50 contains a reactant fluid mixture 100. Upon the blending of the reactants contained in the fluid mixture 100 within the cavity 54, an exothermic reaction ensues. The heat generated by the exothermic reaction is then transferred through the inner wall 52 to a cleaning solution held within the chamber 56 for dispensing by the extraction cleaner. The cleaning solution is dispensed through tube 74 and valve assembly 76 or the solution dispensing system of the extraction cleaner. In one embodiment, the outer wall 50 of the receptacle is thermally insulated to preclude the loss of heat to the atmosphere and to contain the heat generated by the exothermic reaction in the solution within chamber 56 of the clean solution tank. The double wall receptacle forms a heat exchanger between the cavity 54 and the chamber 56 for transfer of the exothermic hear of reaction from the cavity 54 to the chamber 56.

The reactants contained within the cavity 54 between the inner and outer walls 50, 52 are combined to initiate the exothermic reaction. The reactants are capable of separation by the application of opposing electrical charges 60 applied to an anode and cathode 64, 66 mounted within the cavity 54 for emersion in the fluid 100. The anode and the cathode 64, 66 are positioned remotely from one another to maximize the polarization of the reactant fluid 100 and resulting separation of the reactive components. Well-known heat pumps use similar systems in which heat energy is stored in separated components for release of heat energy upon combining of components.

The reactant fluid 100 can be rejuvenated by the application of the electrical potential between the anode 64 and cathode 66 after each use of the solution tank 18, or during pauses in use of the extraction cleaner. An advantage of the exothermic heating is found in the addition of thermal energy to the cleaning solution without the need to expend additional electrical energy during the cleaning process. The available electrical capacity can then be used in other components of the extraction cleaner, such as an agitation brush, suction source, or resistance heater. A resistance heater, such as an in-line heater or an in-tank heater, can be more effective in heating the cleaning solution to a more optimum temperature when used in combination with exothermic heating of the invention.

Figure 4:
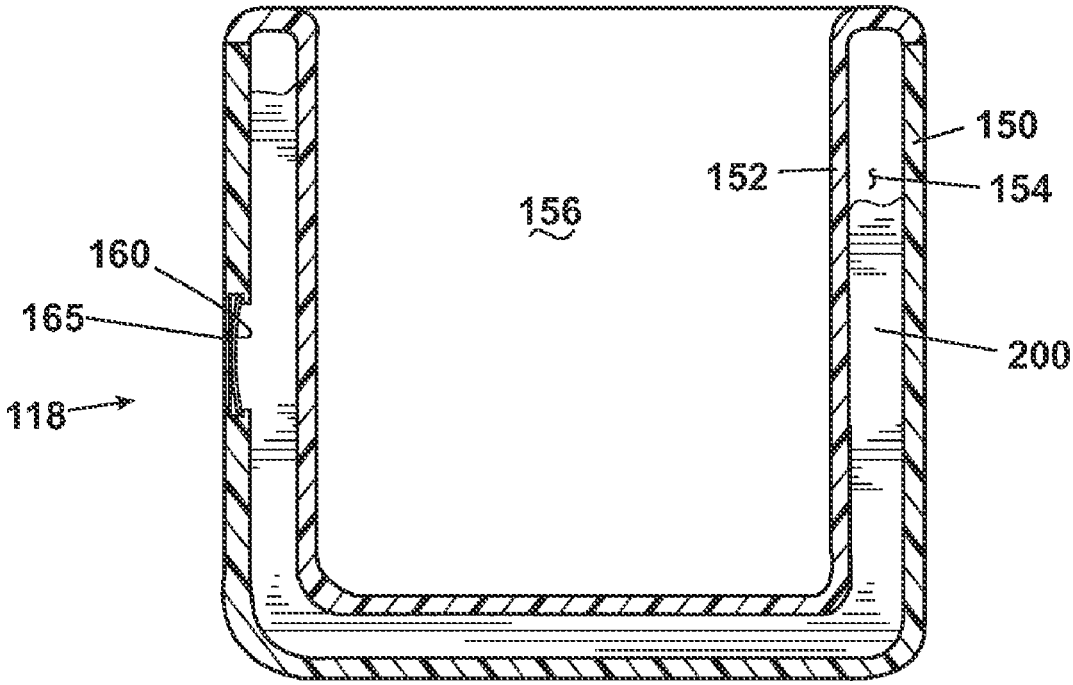
FIG. 4 is a cross-sectional view of a clean solution tank according to a second embodiment of the invention.

In a further embodiment of the invention shown in FIG. 4, the cavity 154 between the inner wall 152 and outer wall 150 of the solution tank 118 contains, by way of example, an aqueous sodium acetate solution 200 and a metallic activation strip 160. The activation strip 160, preferably formed of aluminum, is positioned adjacent a flexible portion 165 of outer wall 150. A user flexes the activation strip to initiate crystallization of the sodium acetate, which is an exothermic reaction. Such a system is disclosed in U.S. Pat. No. 6,029,651, which is incorporated herein by reference. As the sodium acetate crystallizes exothermically, it transfers heat to the cleaning solution within the solution tank 118. After each use, the sodium acetate must be returned to its liquid state. This is commonly accomplished by placing the tank 118 in boiling water or heating in an oven. As the sodium acetate cools, it remains in a supercooled liquid state, storing the energy that it will later release during crystallization. The solution tank 118 is thus reusable.

Figure 5:
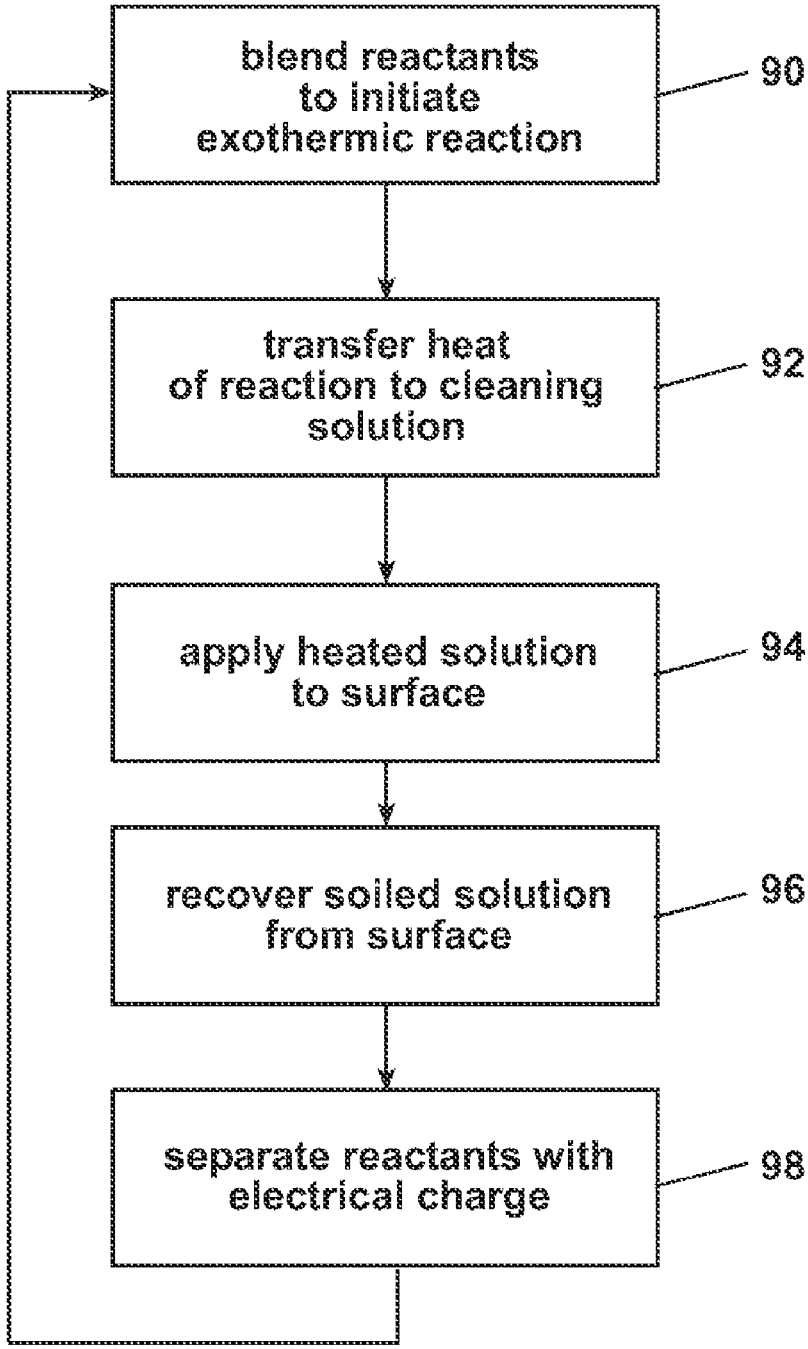
FIG. 5 is a flowchart of an exothermic reaction heating cycle according to the embodiment of FIGS. 2 and 3.
Figure 6:
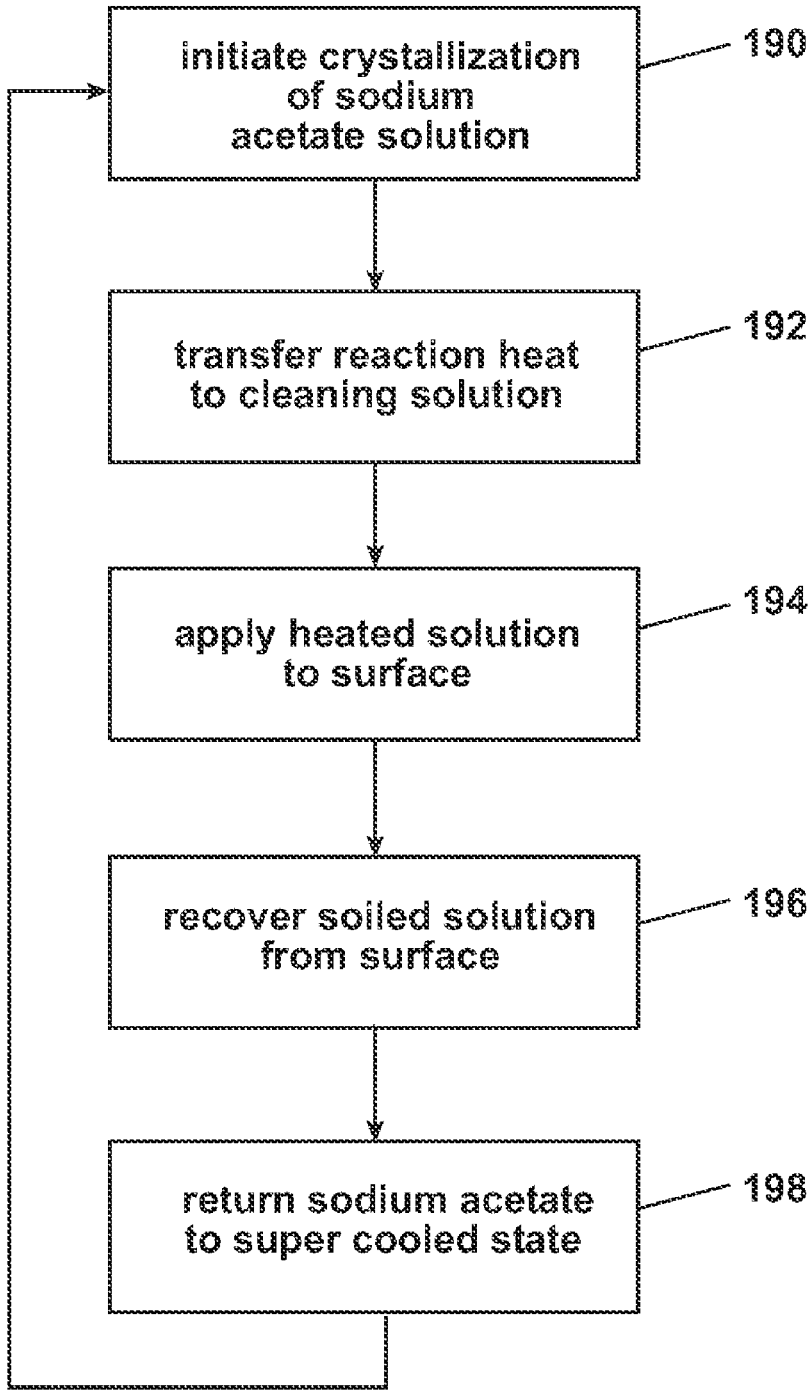
FIG. 6 is a flowchart of an exothermic reaction heating cycle according to the embodiment of FIG. 4.

FIGS. 5-6 are flow charts describing the cycle of use of the embodiments depicted in FIGS. 2-4. Referring first to FIG. 5, the reactants are blended in step 90 to initiate an exothermic reaction. The reactants then transfer heat in step 92 to the cleaning solution contained within the solution tank. The heated cleaning solution is then dispensed by the extraction cleaner in step 94. The soiled solution is then recovered from the surface being cleaned in step 96. The reactants are then returned to their separated state in step 98 by the application of an electrical charge, ready for blending the next time the exothermic reaction is needed to heat a cleaning solution. Alternatively, the spent exothermic solution can be removed from the cavity 54 and discarded and new reactants can be added to the cavity 54 when further heating of the cleaning solution is desired. Alternatively, the spent exothermic solution can be removed from the cavity 54 and separated into its components in an operation outside of the cavity 54. The separated components can then be returned to the cavity 54 when further heating of the cleaning solution is desired.

Referring now to FIG. 6, the process is begun by filling the tank 56 with water or detergent cleaning solution. The first step in the cleaning process is initiating crystallization in step 190 of the sodium acetate solution. The crystallization process is an exothermic reaction, the heat of which is transferred in step 192 to the cleaning solution. The heated cleaning solution is then applied to the surface being cleaned in step 194. The soiled solution is then recovered in step 196. The crystallized sodium acetate is then returned to its supercooled liquid solution form in step 196 by heating above its melting point and air cooling. It can thus be used repeatedly for heating by exothermic reaction.

Figure 7:
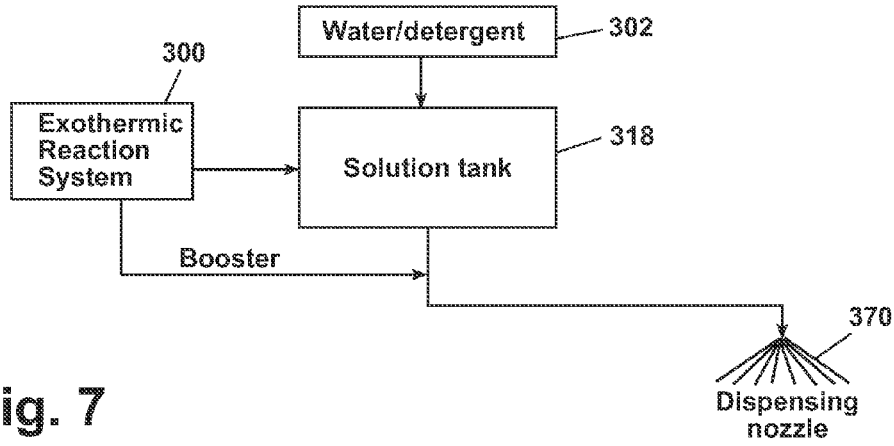
FIG. 7 is a schematic representation of an exothermic reaction heating process according to a third embodiment of the invention.

In a third embodiment of the invention depicted in FIG. 7, a clean solution tank 318 in an extraction cleaner is filled with a cleaning solution 302. The cleaning solution can be at room temperature, or preferably at an elevated temperature. An exothermic heating system 300 according to the invention is then added to the cleaning solution 302 in the clean solution tank 318. The exothermic heating system 300 reacts exothermically within the cleaning solution 302 to further elevate the temperature of the cleaning solution 302. The heated cleaning solution is thus ready for dispensing from a dispensing nozzle 370 onto a surface to be cleaned, the elevated temperature of the solution acting to more effectively remove soil from a surface.

Various combinations of additives that react exothermically are anticipated for use in this and other embodiments of the invention. One example is the addition of a mild acid, such as stearic acid, to the cleaning solution in the solution tank to lower the pH of the cleaning solution to less than 7, and preferably to the range of 4-5. The exothermic reaction is initiated by then adding a mild caustic such as triethanolamine, with a pH greater than 7, and preferably in the range of 8-9. This combination has the further beneficial effect of producing a surfactant that becomes part of the cleaning solution. Other acid/base combinations are equally anticipated for use, including citric or phosphoric acids, and diethanolamine, sodium hydroxide or potassium hydroxide. More aggressive exothermic reactions are available by the addition of metallic exothermic heating systems such as aluminum, which react with the caustic compounds. All of these compounds can be used either within the cleaning solution or, in some cases, in the cavity 54 of the embodiment of FIG. 3.

In the embodiment shown in FIG. 7, additional exothermic heating system 300 in the form of a booster can be added to the cleaning solution as it is being dispensed so that the ongoing exothermic reaction further elevates the temperature of the applied cleaning solution as it is being dispensed onto the carpet or floor surface. The booster can be added directly to the cleaning solution or can be passed through a heat exchanger to indirectly transfer heat from the booster to the cleaning solution in line.

In the embodiment of FIG. 7, the exothermic heating system added to the cleaning solution can be configured or selected to behave in a time-release fashion. The exothermic reaction thereby takes place over an extended period of time and maintains the cleaning solution at an elevated temperature for a longer period of time.

Figure 8:
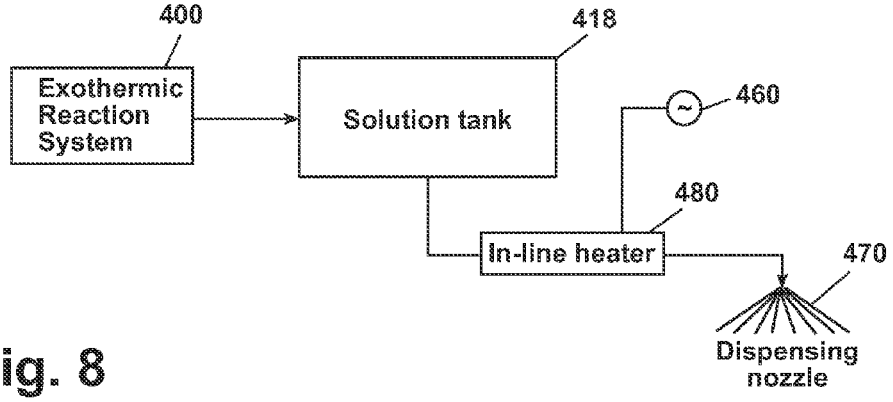
FIG. 8 is a schematic representation of an exothermic reaction heating process according to a fourth embodiment of the invention.

Referring now to FIG. 8, in a fourth embodiment of the invention, the exothermic reaction generated by the addition of exothermic heating system 400 to a cleaning solution within the solution tank 418 elevates the temperature of the cleaning solution. This elevated temperature may yet remain below the optimal temperature determined for the cleaning solution to be effective on a surface to be cleaned. The heating effect of the exothermic reaction is then supplemented by the injection of heat energy into the cleaning solution by an in-line heater 480, having an electrical power source 460, fluidly connected between the clean solution tank 418 and a dispensing nozzle 470 on the extraction cleaner.

Figure 9:
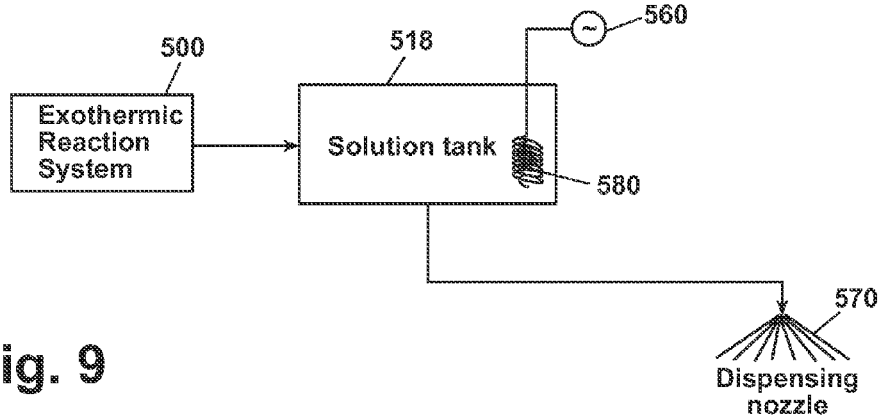
FIG. 9 is a schematic representation of an exothermic reaction heating process according to a fifth embodiment of the invention.

In a fifth embodiment of the invention shown in FIG. 9, the exothermic reaction generated by the addition of exothermic heating system 500 to a cleaning solution within the solution tank 518 elevates the temperature of the cleaning solution. The energy released by this exothermic reaction is supplemented by an in-tank heater 580, having electrical power source 560, positioned within the solution tank 518 to elevate the temperature of the cleaning solution to an optimal temperature for effectiveness of the cleaning solution on the surface to be cleaned.

Figure 10:
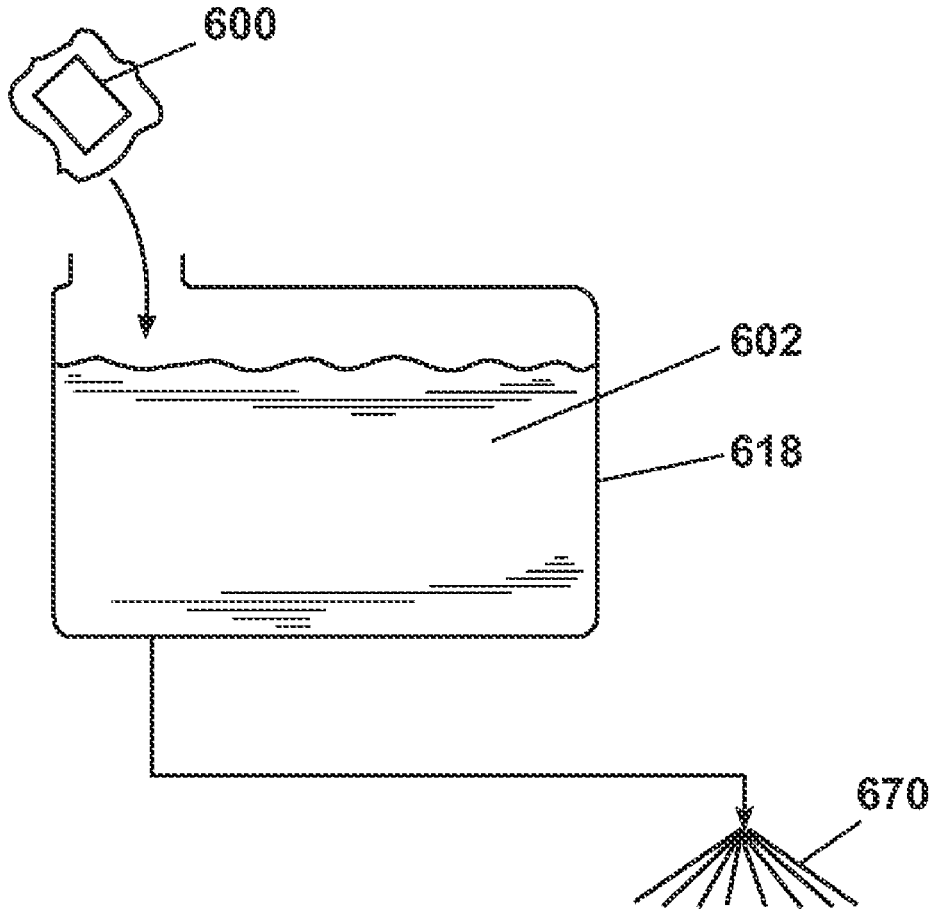
FIG. 10 is a schematic representation of an exothermic reaction heating process according to a sixth embodiment of the invention.

Referring to FIG. 10, in a sixth embodiment of the invention, the exothermic heating system 600 comprises a supercorroding metallic alloy powder dispersed throughout a porous polyethylene matrix and contained by a porous envelope, for reaction with an appropriate electrolytic solution. An example of this system is disclosed in U.S. Pat. No. 4,522,190, which is incorporated herein by reference. In FIG. 10, the system 600 is immersed in the cleaning solution 602. The cleaning solution 602 penetrates the porous envelope to react with the system 600. It is anticipated that the system 600 can be placed in the cleaning solution 602 in the solution tank 618 shortly before dispensing the cleaning solution 602 through a dispensing nozzle 670.

The invention has been illustrated with respect to a particular upright extraction cleaning machine. The invention is applicable to all types of extraction cleaning machines, including commercial cleaning machines as well as domestic cleaning machines, canister extractors, hand held portable extractors.

While the invention has been specifically described in connection with certain specific embodiments thereof, it is to be understood that this is by way of illustration and not of limitation. Reasonable variation and modification are possible within the forgoing description and drawings without departing from the spirit of the invention, which is embodied in the appended claims.

What is claimed is:

1. A kit for cleaning a surface to be cleaned comprising:

a cleaning solution that is adapted to remove soil from the surface to be cleaned and an extraction cleaner having:

a housing;

a cleaning solution dispensing system mounted to the housing and comprising a cleaning solution tank for storing a quantity of the cleaning solution, a fluid delivery nozzle and a fluid conduit between the cleaning solution tank and the fluid delivery nozzle to dispense the cleaning solution to the surface to be cleaned;

a fluid recovery system mounted to the housing for recovering soiled cleaning solution from the surface to be cleaned and including a suction nozzle, a recovery tank and a suction source in communication with the suction nozzle and the recovery tank for drawing dirty liquid from the surface to be cleaned and for depositing it in the recovery tank; and an exothermic heating system adapted to be placed in heat exchange relationship with the cleaning solution dispensing system to heat the cleaning solution to a temperature above room temperature for application to the surface to be cleaned;

wherein the exothermic heating system comprises at least one reagent that is adapted to generate an exothermic reaction, and wherein, when the cleaning solution is added to the cleaning solution dispensing system, the exothermic heating system is placed in heat exchange relationship with the cleaning solution dispensing system and the exothermic heating system is activated to generate an exothermic reaction, the cleaning solution is heated, whereby the cleaning solution thus heated can be applied to a surface to be cleaned for enhanced cleaning.

2. The kit for cleaning a surface according to claim 1 wherein the heater further comprises a heat exchanger in heat exchange relationship with the cleaning solution in the fluid conduit between the cleaning solution tank and the fluid delivery nozzle when the cleaning solution is added to the cleaning solution dispensing system.

3. The kit for cleaning a surface according to claim 1 wherein the exothermic heating system comprises at least one of a compound and a composition that generates heat when transforming from one phase to another.

4. The kit for cleaning a surface according to claim 3 wherein the phase change is from a liquid to a solid.

5. The kit for cleaning a surface according to claim 4 wherein the exothermic heating system comprises a sodium acetate solution.

6. The kit for cleaning a surface according to claim 5 wherein the exothermic heating system comprises an activator that can be introduced into the sodium acetate solution.

7. The kit for cleaning a surface according to claim 6 wherein the activator includes a metal that can be introduced into the liquid.

8. The kit for cleaning a surface according to claim 7 wherein the activator includes at least one of aluminum and an alloy thereof.

9. The kit for cleaning a surface according to claim 3 wherein the phase change is from one solid phase to another.

10. The kit for cleaning a surface according to claim 1 wherein the exothermic heating system comprises two or more reagents that, when combined, undergo an exothermic reaction.

11. The kit for cleaning a surface according to claim 10 wherein the two or more reagents include a base and an acid that undergo an exothermic reaction when combined.

12. The kit for cleaning a surface according to claim 10 wherein the two or more reagents are aluminum and a reactant caustic compound.

13. The kit for cleaning a surface according to claim 10 wherein the two or more reagents include a supercorroding metal alloy.

14. The kit for cleaning a surface according to claim 11 wherein the acid is selected from the group consisting of stearic acid, citric acid and phosphoric acids.

15. The kit for cleaning a surface according to claim 11 wherein the base is selected from the group consisting of diethanolamine, triethanolamine, sodium hydroxide and potassium hydroxide.

16. The kit for cleaning a surface according to claim 1 wherein the exothermic heating system comprises a mild acid in the cleaning solution tank and the cleaning solution has a pH of less than 7.

17. The kit for cleaning a surface according to claim 16 wherein the mild acid is a stearic acid.

18. The kit for cleaning a surface according to claim 17 wherein the pH of the cleaning solution in the cleaning solution tank is in the range of 4-5.

19. The kit for cleaning a surface according to claim 16 wherein a reaction product of the mild acid and the base is a surfactant that becomes part of the cleaning solution.

20. The kit for cleaning a surface according to claim 17 wherein the base is triethanolamine and forms an activator for the exothermic reaction when added to the stearic acid-containing cleaning solution.

21. The kit for cleaning a surface according to claim 20 wherein the triethanolamine is in a solution that has a pH in the range of 8-9 prior to adding it to the stearic acid-containing cleaning solution.

22. The kit for cleaning a surface according to claim 1 wherein the exothermic heating system is within the cleaning solution tank whereby the heat of the exothermic reaction is transferred directly to the cleaning solution.

23. The kit for cleaning a surface according to claim 1 wherein the heater comprises a cavity adjacent the cleaning solution tank in heat exchange relationship with cleaning solution in the cleaning solution tank.

24. The kit for cleaning a surface according to claim 23 wherein the exothermic reaction occurs within the heater cavity adjacent the cleaning solution tank whereby the heat of the exothermic reaction is transferred to the cleaning solution through the cleaning solution tank.

25. The kit for cleaning a surface according to claim 23 wherein an activator is integral with a wall of the heater cavity.

26. An extraction cleaner comprising:

a housing;

a cleaning solution dispensing system mounted to the housing and comprising a cleaning solution tank for storing a quantity of cleaning solution, a fluid delivery nozzle and a fluid conduit between the cleaning solution tank and the fluid delivery nozzle to dispense cleaning fluid to a surface to be cleaned;

a fluid recovery system mounted to the housing for recovering soiled cleaning fluid from the surface to be cleaned;

a heater in heat exchange relationship with the cleaning solution dispensing system to heat the cleaning solution to a temperature above room temperature, the heater including a double wall receptacle having an outer wall and an inner wall, the inner wall defining the cleaning solution tank for storing the cleaning solution, the inner and outer wall defining a reagent cavity, and an exothermic heating system comprising at least one reagent and at least one activator, the at least one activator being integral with the outer wall of the reagent cavity, for generating heat through an exothermic reaction in the reagent cavity;

wherein, when heat is generated in the reagent cavity by the exothermic heating system, the heat is transferred from the reagent cavity to the cleaning solution in the cleaning solution tank through the inner wall of the heater.

27. The extraction cleaner according to claim 26 wherein the activator initiates an exothermic phase change in the reagent that generates heat.

28. The extraction cleaner according to claim 26 wherein the reagent comprises a sodium acetate solution.

29. The extraction cleaner according to claim 26 wherein the activator comprises a metal.

30. The extraction cleaner according to claim 29 wherein the activator is selected from at least one of aluminum and an aluminum alloy.

31. The extraction cleaner according to claim 26 wherein the exothermic heating system can be regenerated by applying heat to induce a phase change.

32. The extraction cleaner according to claim 26 wherein the exothermic heating system comprises two or more reagents that, when combined, undergo an exothermic reaction.

33. An extraction cleaner comprising:

a housing;

a cleaning solution dispensing system mounted to the housing and comprising a cleaning solution tank for storing a quantity of cleaning solution, a fluid delivery nozzle and a fluid conduit between the cleaning solution tank and the fluid delivery nozzle to dispense cleaning fluid to a surface to be cleaned;

a fluid recovery system mounted to the housing for recovering soiled cleaning fluid from the surface to be cleaned;

a heater in heat exchange relationship with the cleaning solution dispensing system to heat the cleaning solution to a temperature above room temperature, the heater including a double wall receptacle having an outer wall and an inner wall, the inner wall defining the cleaning solution tank for storing the cleaning solution, the inner and outer wall defining a reagent cavity, an exothermic heating system comprising at least one reagent for generating heat through an exothermic reaction in the reagent cavity, and at least one anode and at least one cathode located within the reagent cavity;

wherein, when heat is generated in the reagent cavity by the exothermic heating system, the heat is transferred from the reagent cavity to the cleaning solution in the cleaning solution tank through the inner wall of the heater and wherein the exothermic heating system can be regenerated by applying an electric potential across the at least one anode and the at least one cathode.

34. The extraction cleaner according to claim 33 wherein the exothermic heating system comprises two or more reagents that, when combined, undergo an exothermic reaction.

* * * * *